US006185533B1

(12) United States Patent
Holm et al.

(10) Patent No.: US 6,185,533 B1
(45) Date of Patent: Feb. 6, 2001

(54) GENERATION AND SYNTHESIS OF PROSODY TEMPLATES

(75) Inventors: Frode Holm; Kazue Hata, both of Santa Barbara, CA (US)

(73) Assignee: Matsushita Electric Industrial Co., Ltd., Osaka (JP)

( * ) Notice: Under 35 U.S.C. 154(b), the term of this patent shall be extended for 0 days.

(21) Appl. No.: 09/268,229

(22) Filed: Mar. 15, 1999

(51) Int. Cl.[7] ..... G10L 13/06; G10L 13/00; G10L 21/00

(52) U.S. Cl. ..... 704/267; 704/224; 704/258; 704/264; 704/211

(58) Field of Search ..... 704/200–260, 704/267, 264; 434/157

(56) References Cited

U.S. PATENT DOCUMENTS

| | | | | |
|---|---|---|---|---|
| 5,230,037 | * | 7/1993 | Giustiniani et al. | 704/200 |
| 5,278,943 | * | 1/1994 | Gasper et al. | 704/200 |
| 5,384,893 | | 1/1995 | Hutchins . | |
| 5,592,585 | | 1/1997 | Van Coile et al. . | |
| 5,636,325 | | 6/1997 | Farrett . | |
| 5,642,520 | | 6/1997 | Takeshita et al. . | |
| 5,652,828 | | 7/1997 | Silverman . | |
| 5,696,879 | | 12/1997 | Cline et al. . | |
| 5,704,009 | | 12/1997 | Cline et al. . | |
| 5,727,120 | | 3/1998 | Van Coile et al. . | |
| 5,729,694 | | 3/1998 | Holzrichter et al. . | |
| 5,732,395 | | 3/1998 | Silverman . | |
| 5,749,071 | | 5/1998 | Silverman . | |
| 5,751,906 | | 5/1998 | Silverman . | |
| 5,796,916 | | 8/1998 | Meredith . | |
| 5,828,994 | * | 10/1998 | Covell et al. | 704/211 |
| 6,029,131 | * | 2/2000 | Bruckert | 704/260 |

OTHER PUBLICATIONS

Bailly (G. Bailly, "Integration of Rhythmic and Syntactic Constraints in a Model of Generation of French Prosody," Elsevier Science Publishers, Jun. 1989).*

Campbell, W. N., "Syllable–based Segmental Duration", pp. 211–224, (Undated), *Talking Machines: Theories, Models, and Designs*, copyright 1992, Elsevier Science Publishers B.V.

* cited by examiner

*Primary Examiner*—Tālivaldis I. Šmits
*Assistant Examiner*—Daniel A. Nolan
(74) *Attorney, Agent, or Firm*—Harness, Dickey & Pierce, P.L.C.

(57) ABSTRACT

A method of separating high-level prosodic behavior from purely articulatory constraints so that timing information can be extracted from human speech is presented. The extracted timing information is used to construct duration templates that are employed for speech synthesis. The duration templates are constructed so that words exhibiting the same stress pattern will be assigned the same duration template. Initially, the words of input text segmented into phonemes and syllables, and the associated stress pattern is assigned. The stress assigned words are then assigned grouping features by a text grouping module. A phoneme cluster module groups the phonemes into phoneme pairs and single phonemes. A static duration associated with each phoneme pair and single phoneme is retrieved from a global static table. A normalization module generates a normalized syllable duration value based upon the retrieved static durations associated with the phonemes that comprise the syllable. The normalized syllable duration value is stored in a duration template based upon the grouping features associated with that syllable. To produce natural human-sounding prosody in synthesized speech, the duration information is then extracted from the selected template, de-normalized and applied to the phonemic information.

18 Claims, 8 Drawing Sheets

34
Sample Text
40
Phonetic Processor Module
38
Text Grouping Module
30
Word Database
44
42
Phoneme Clustering Module
Normalization Module
32
Global Static Table
36
Duration Templates
Statistical Measures
- mean
- standard deviation
- maximum
- minimum
- covariance

GENERATION AND SYNTHESIS OF PROSODY TEMPLATES

BACKGROUND AND SUMMARY OF THE INVENTION

The present invention relates generally to text-to-speech (tts) systems and speech synthesis. More particularly, the invention relates to a system for generating duration templates which can be used in a text-to-speech system to provide more natural sounding speech synthesis.

The task of generating natural human-sounding prosody for text-to-speech and speech synthesis has historically been one of the most challenging problems that researchers and developers have had to face. Text-to-speech systems have in general become infamous for their unnatural prosody such as "robotic" intonations or incorrect sentence rhythm and timing. To address this problem some prior systems have used neural networks and vector clustering algorithms in an attempt to simulate natural sounding prosody. Aside from being only marginally successful, these "black box" computational techniques give the developer no feedback regarding what the crucial parameters are for natural sounding prosody.

The present invention builds upon a different approach which was disclosed in a prior patent application entitled "Speech Synthesis Employing Prosody Templates". In the disclosed approach, samples of actual human speech are used to develop prosody templates. The templates define a relationship between syllabic stress patterns and certain prosodic variables such as intonation (F0) and duration, especially focusing on F0 templates. Thus, unlike prior algorithmic approaches, the disclosed approach uses naturally occurring lexical and acoustic attributes (e.g., stress pattern, number of syllables, intonation, duration) that can be directly observed and understood by the researcher or developer.

The previously disclosed approach stores the prosody templates for intonation (F0) and duration information in a database that is accessed by specifying the number of syllables and stress pattern associated with a given word. A word dictionary is provided to supply the system with the requisite information concerning number of syllables and stress patterns. The text processor generates phonemic representations of input words, using the word dictionary to identify the stress pattern of the input words. A prosody module then accesses the database of templates, using the number of syllables and stress pattern information to access the database. A prosody template for the given word is then obtained from the database and used to supply prosody information to the sound generation module that generates synthesized speech based on the phonemic representation and the prosody information.

The previously disclosed approach focuses on speech at the word level. Words are subdivided into syllables and thus represent the basic unit of prosody. The stress pattern defined by the syllables determines the most perceptually important characteristics of both intonation (F0) and duration. At this level of granularity, the template set is quite small in size and easily implemented in text-to-speech and speech synthesis systems. While a word level prosodic analysis using syllables is presently preferred, the prosody template techniques of the invention can be used in systems exhibiting other levels of granularity. For example, the template set can be expanded to allow for more grouping features, both at the sentence and word level. In this regard, duration modification (e.g. lengthening) caused by phrase or sentence position and type, segmental structure in a syllable, and phonetic representation can be used as attributes with which to categorize certain prosodic patterns.

Although text-to-speech systems based upon prosody templates that are derived from samples of actual human speech have held out the promise of greatly improved speech synthesis, those systems have been limited by the difficulty of constructing suitable duration templates. To obtain temporal prosody patterns the purely segmental timing quantities must be factored out from the larger scale prosodic effects. This has proven to be much more difficult than constructing F0 templates, wherein intonation information can be obtained by visually examining individual F0 data.

The present invention presents a method of separating high-level prosodic behavior from purely articulatory constraints so that high-level timing information can be extracted from human speech. The extracted timing information is used to construct duration templates that are employed for speech synthesis. Initially, the words of input text are segmented into phonemes and syllables and the associated stress pattern is assigned. The stress assigned words can then be assigned grouping features by a text grouping module. A phoneme cluster module groups the phonemes into phoneme pairs and single phonemes. A static duration associated with each phoneme pair and single phoneme is retrieved from a global static table. A normalization module generates a normalized duration value for a syllable based upon lengthening or shortening of the global static durations associated with the phonemes that comprise the syllable. The normalized duration value is stored in a duration template based upon the grouping features associated with that syllable.

For a more complete understanding of the invention, its objectives and advantages, refer to the following specification and to the accompanying drawings.

DESCRIPTION OF THE PREFERRED EMBODIMENT

When text is read by a human speaker, the pitch rises and falls, syllables are enunciated with greater or lesser intensity, vowels are elongated or shortened, and pauses are inserted, giving the spoken passage a definite rhythm. These features comprise some of the attributes that speech researchers refer to as prosody. Human speakers add prosodic information automatically when reading a passage of text aloud. The prosodic information conveys the reader's interpretation of the material. This interpretation is an artifact of human experience, as the printed text contains little direct prosodic information.

When a computer-implemented speech synthesis system reads or recites a passage of text, this human-sounding prosody is lacking in conventional systems. Quite simply, the text itself contains virtually no prosodic information, and the conventional speech synthesizer thus has little upon which to generate the missing prosody information. As noted earlier, prior attempts at adding prosody information have focused on ruled-based techniques and on neural network techniques or algorithmic techniques, such as vector clustering techniques. Rule-based techniques simply do not sound natural and neural network and algorithmic techniques cannot be adapted and cannot be used to draw inferences needed for further modification or for application outside the training set used to generate them.

Figure 1:
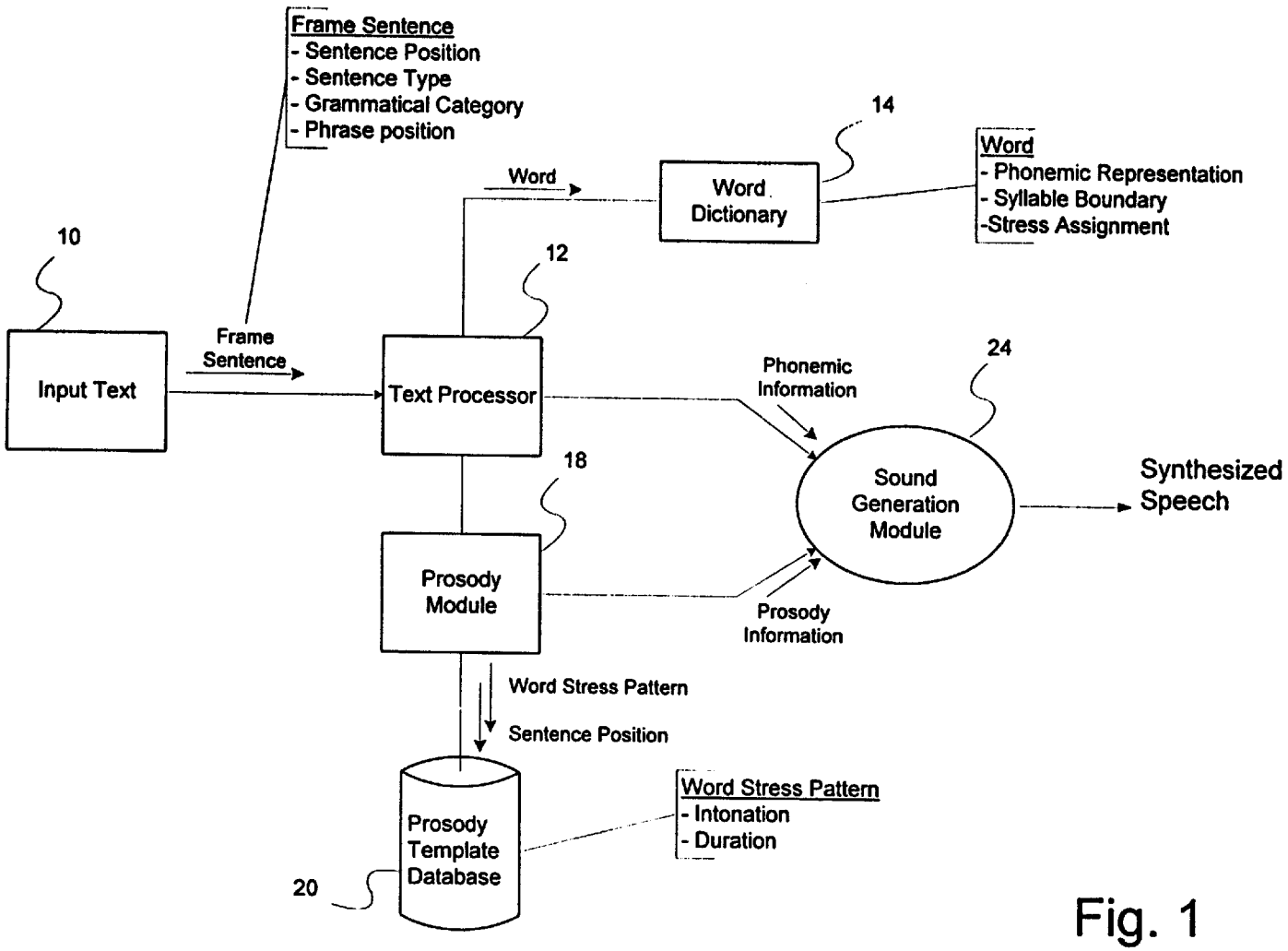
FIG. 1 is a block diagram of a speech synthesizer employing prosody templates.

FIG. 1 illustrates a speech synthesizer that employs prosody template technology. Referring to FIG. 1, an input text 10 is supplied to text processor module 12 as a frame sentence comprising a sequence or string of letters that define words. The words are defined relative to the frame sentence by characteristics such as sentence position, sentence type, phrase position, and grammatical category. Text processor 12 has an associated word dictionary 14 containing information about a plurality of stored words. The word dictionary has a data structure illustrated at 16 according to which words are stored along with associated word and sentence grouping features. More specifically, in the presently preferred embodiment of the invention each word in the dictionary is accompanied by its phonemic representation, information identifying the syntactic boundaries, information designating how stress is assigned to each syllable, and the duration of each constituent syllable. Although the present embodiment does not include sentence grouping features in the word dictionary 14, it is within the scope of the invention to include grouping features with the word dictionary 14. Thus the word dictionary 14 contains, in searchable electronic form, the basic information needed to generate a pronunciation of the word.

Text processor 12 is further coupled to prosody module 18 which has associated with it the prosody template database 20. The prosody templates store intonation (F0) and duration data for each of a plurality of different stress patterns. The single-word stress pattern '1' comprises a first template, the two-syllable pattern '10' comprises a second template, the pattern '01' comprises yet another template, and so forth. The templates are stored in the database by grouping features such as word stress pattern and sentence position. In the present embodiment the stress pattern associated with a given word serves as the database access key with which prosody module 18 retrieves the associated intonation and duration information. Prosody module 18 ascertains the stress pattern associated with a given word by information supplied to it via text processor 12. Text processor 12 obtains this information using the word dictionary 14.

The text processor 12 and prosody module 18 both supply information to the sound generation module 24. Specifically, text processor 12 supplies phonemic information obtained from word dictionary 14 and prosody module 18 supplies the prosody information (e.g. intonation and duration). The sound generation module then generates synthesized speech based on the phonemic and prosody information.

The present invention addresses the prosody problem through the use of duration and F0 templates that are tied to grouping features such as the syllabic stress patterns found within spoken words. More specifically, the invention provides a method of extracting and storing duration information from recorded speech. This stored duration information is captured within a database and arranged according to grouping features such as syllabic stress patterns.

The presently preferred embodiment encodes prosody information in a standardized form in which the prosody information is normalized and parameterized to simplify storage and retrieval within database 20. The prosody module 18 de-normalizes and converts the standardized templates into a form that can be applied to the phonemic information supplied by text processor 12. The details of this process will be described more fully below. However, first, a detailed description of the duration templates and their construction will be described.

Figure 2:
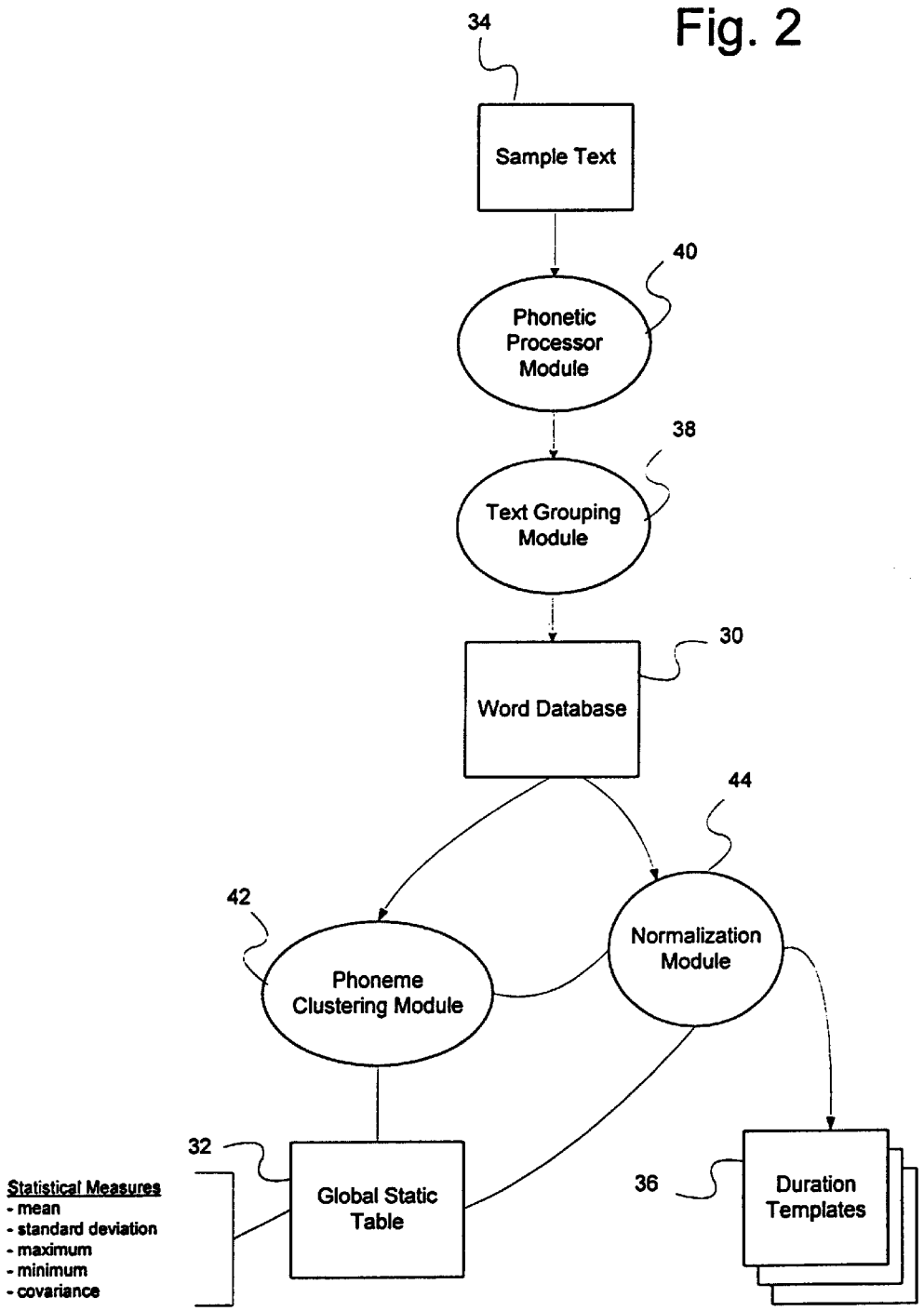
FIG. 2 is a block diagram of an apparatus for generating prosody duration templates.

Referring to FIG. 2, an apparatus for generating suitable duration templates is illustrated. To successfully factor out purely segmental timing quantities from the larger scale prosodic effects a scheme has been devised to first capture the natural segmental duration characteristics. In the presently preferred embodiment the duration templates are constructed using sentences having proper nouns in various sentence positions. The presently preferred implementation was constructed using approximately 2000 labeled recordings (single words) spoken by a female speaker of American English. The sentences may also be supplied as a collection of pre-recorded or fabricated frame sentences. The words are entered as sample text 34 which is segmented into phonemes before being grouped into constituent syllables and assigned associated grouping features such as syllable stress pattern. Although in the presently preferred embodiment the sample text is entered as recorded words, it is within the scope of the invention to enter the sample text 34 as unrecorded sentences and assign phrase and sentence grouping features in addition to word grouping features to the subsequently segmented syllables. The syllables and related information are stored in a word database 30 for later data manipulation in creating a global static table 32 and duration templates 36. Global static duration statistics such as the mean, standard deviation, minimum duration, maximum duration, and covariance that are derived from the information in the word database 30 are stored in the global static table 32. Duration templates are constructed from syllable duration statistics that are normalized with respect to static duration statistics stored in the global static table 32. Normalized duration statistics for the syllables are stored in duration templates 36 that are organized according to grouping features. Following are further details of the construction of the global static table 32, duration templates 36, and the process of segmenting syllables into phonemes.

Figure 3:
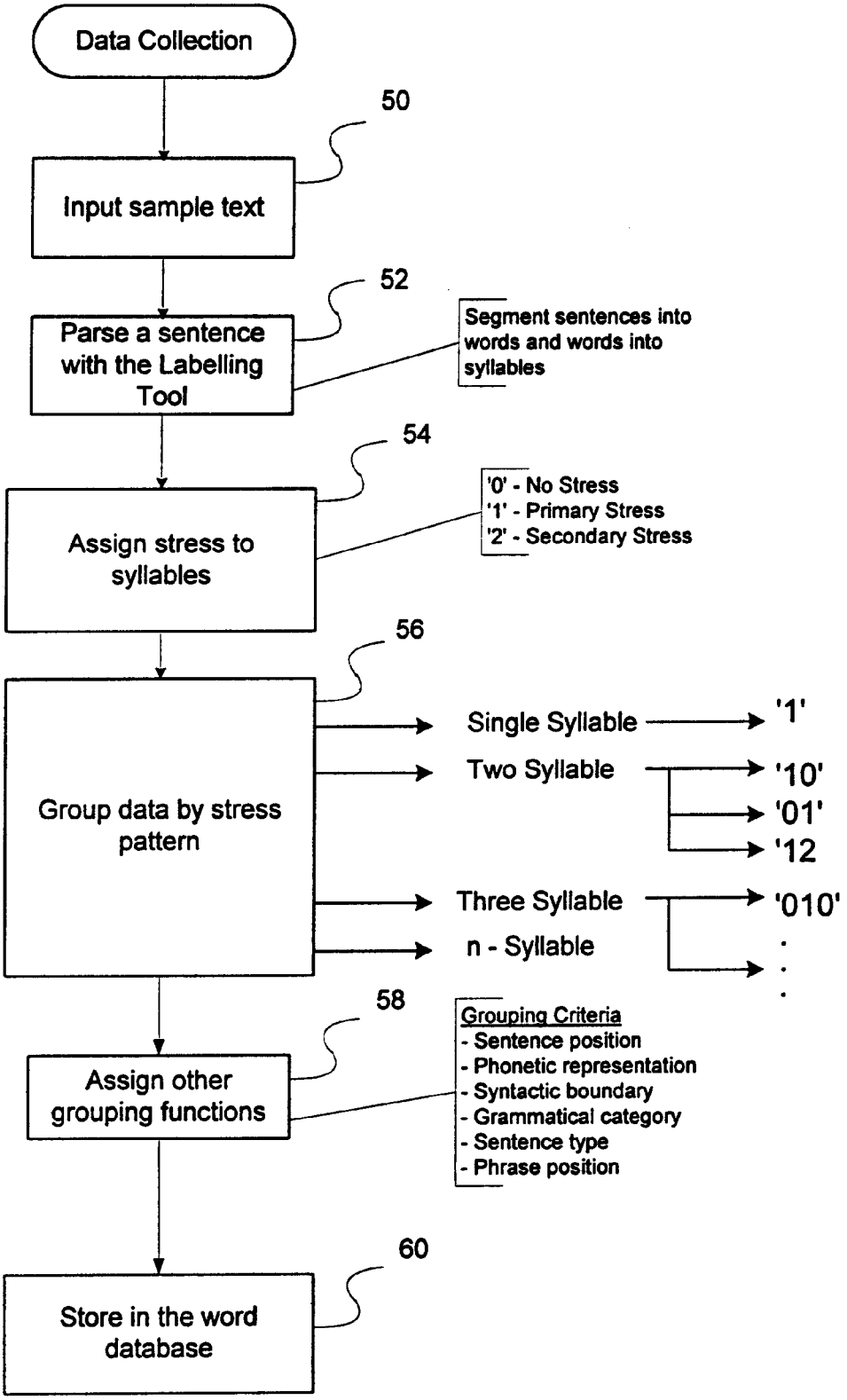
FIG. 3 is a flow diagram illustrating the procedure for collecting temporal data.

Referring to FIG. 3 in addition to FIG. 2, the collection of temporal data is illustrated. At step 50 sample text 34 is input for providing duration data. The sample text 34 is initially p re-processed through a phonetic processor module 40 which at step 52 uses an HMM-based automatic labeling tool and an automatic syllabification tool to segment words into input phonemes and group the input phonemes into syllables respectively. The automatic labeling is followed by a manual correction for each string. Then, at step 54 the stress pattern for the target words is assigned by ear using three different stress levels. These are designated by numbers 0, 1 and 2. The stress levels incorporate the following:

| | |
|---|---|
| 0 | no stress |
| 1 | primary stress |
| 2 | secondary stress |

According to the preferred embodiment, single-syllable words are considered to have a simple stress pattern corresponding to the primary stress level '1.' Multi-syllable words can have different combinations of stress level patterns. For example, two-syllables words may have stress patterns '10', '01' and '12.' The presently preferred embodiment employs a duration template for each different stress pattern combination. Thus stress pattern '1' has a first duration template, stress pattern '10' has a different template, and so forth. In marking the syllable boundary, improved statistical duration measures are obtained when the boundary is marked according to perceptual rather than spectral criteria. Each syllable is listened to individually and the marker placed where no rhythmic 'residue' is perceived on either side.

Although in the presently preferred implementation, a three-level stress assignment is employed, it is within the scope of the invention to either increase or decrease the number of levels. Subdivision of words into syllables and phonemes and assigning the stress levels can be done manually or with the assistance of an automatic or semi-automatic tracker. In this regard, the pre-processing of training speech data is somewhat time-consuming, however it only has to be performed once during development of the prosody templates. Accurately labeled and stress-assigned data is needed to insure accuracy and to reduce the noise level in subsequent statistical analysis.

After the words have been labeled and stresses assigned, they may be grouped by a text grouping module 38; according to stress pattern or other grouping features such as phonetic representation, syntactic boundary, sentence position, sentence type, phrase position, and grammatical category. In the presently preferred embodiment the words are grouped by stress pattern. As illustrated at step 56, single-syllable words comprise a first group. Two-syllable words comprise four additional groups, the '10' group, the '01' group, the '12' group and the '21' group. Similarly three-syllable, four-syllable, through n-syllable words can be similarly grouped according to stress patterns. At step 58 other grouping features may be additionally assigned to the words. At step 60 the processed data is then stored in a word database 30 organized by grouping features, words, syllables, and other relevant criteria. The word database provides a centralized collection of prosody information that is available for data manipulation and extraction in the construction of the global static table and duration templates.

Figure 4:
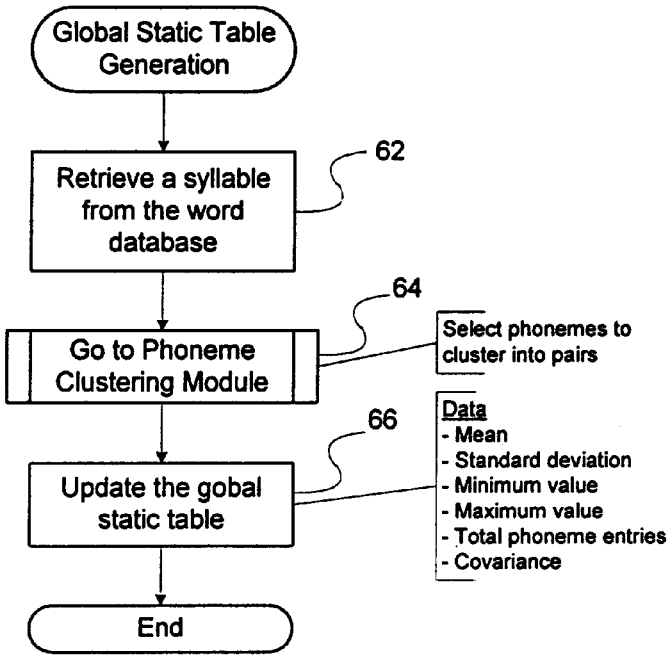
FIG. 4 is a flowchart diagram illustrating the procedure for creating a global static table.

Referring to FIGS. 2 and 4, the generation of the global static table 32 is illustrated. The global static table 32 provides a global database of phoneme static duration data to be used in normalizing phoneme duration information for constructing the duration templates. The entire segmented corpus is contained within the global static table 32. At step 62 duration information related to a syllable is retrieved from the word database 30. At step 64 the phoneme clustering module 42 is accessed to group those phonemes into phoneme pairs and single phonemes. At step 66, the global static table 32 is updated with new data including mean, standard deviation, minimum and maximum values and the total phoneme entries of the phoneme static duration data.

Figure 5:
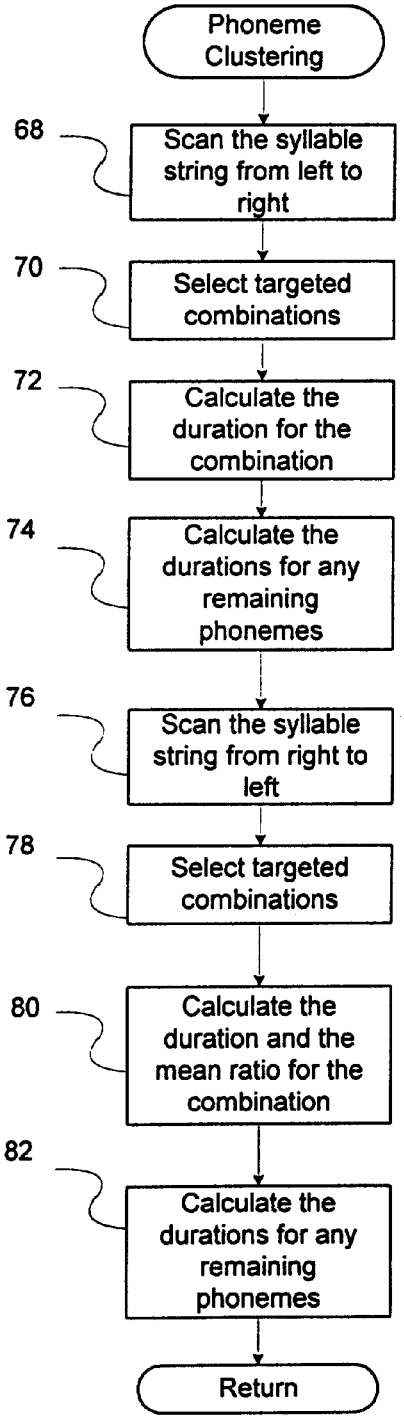
FIG. 5 is a flowchart diagram illustrating the procedure for clustering phonemes into pairs.

Referring to FIGS. 2 and 5, the phoneme clustering module is illustrated. The phoneme clustering module 42 selects which phonemes to cluster into pairs based upon a criterion of segmental overlap, or expressed another way, how difficult it is to manually segment the syllable in question. At step 68 the syllable string is scanned from left to right to determine if it contains a targeted combination. In the present embodiment, examples of targeted combinations include the following:

a) "L" or "R" or "Y" or "W" followed by a vowel, b) A vowel followed by "L" or "R" or "N" or "M" or "NG", c) A vowel and "R" followed by "L", d) A vowel and "L" followed by "R", e) "L" followed by "M" or "N", and f) Two successive vowels.

At step 70 targeted combinations are removed from the string and at step 72 the duration data for the phoneme pair corresponding to the targeted combination is calculated by retrieving duration data from the word database 30. The duration data for the phoneme pair is stored in the global static table 32 either as a new entry or accumulated with an existing entry for that phoneme pair. Although in the preferred embodiment the mean, standard deviation, maximum, minimum duration, and covariance for the phoneme pair is recorded, additional statistical measures are within the scope of the invention. The remainder of the syllable string is scanned for other targeted combinations which are also removed and the duration data for the pair calculated and entered into the global static table 32. After all the phoneme pairs are removed from the syllable string only single phonemes remain. At step 74 the duration data for the single phonemes is retrieved from the word database 30 and stored in the global static table 32.

At step 76 the syllable string is then scanned from right to left to determine if the string contains one of the earlier listed targeted combinations. Steps 78, 80, and 82 then repeat the operation of steps 70 through 74 in scanning for phoneme pairs and single phonemes and entering the calculated duration data into the global static table 32. Although scanning left to right in addition to scanning right to left produces some overlap, and therefore a possible skewness, the increased statistical accuracy for each individual entry outweighs this potential source of error. Following step 82, control returns to the global static table generation module which continues operation until each syllable of each word has been segmented. In the presently preferred implementation all data for a given phoneme pair or single phoneme are averaged irrespective of grouping feature and this average is used to populate the global static table 32. While arithmetic averaging of the data gives good results, other statistical processing may also be employed if desired.

Figure 6:
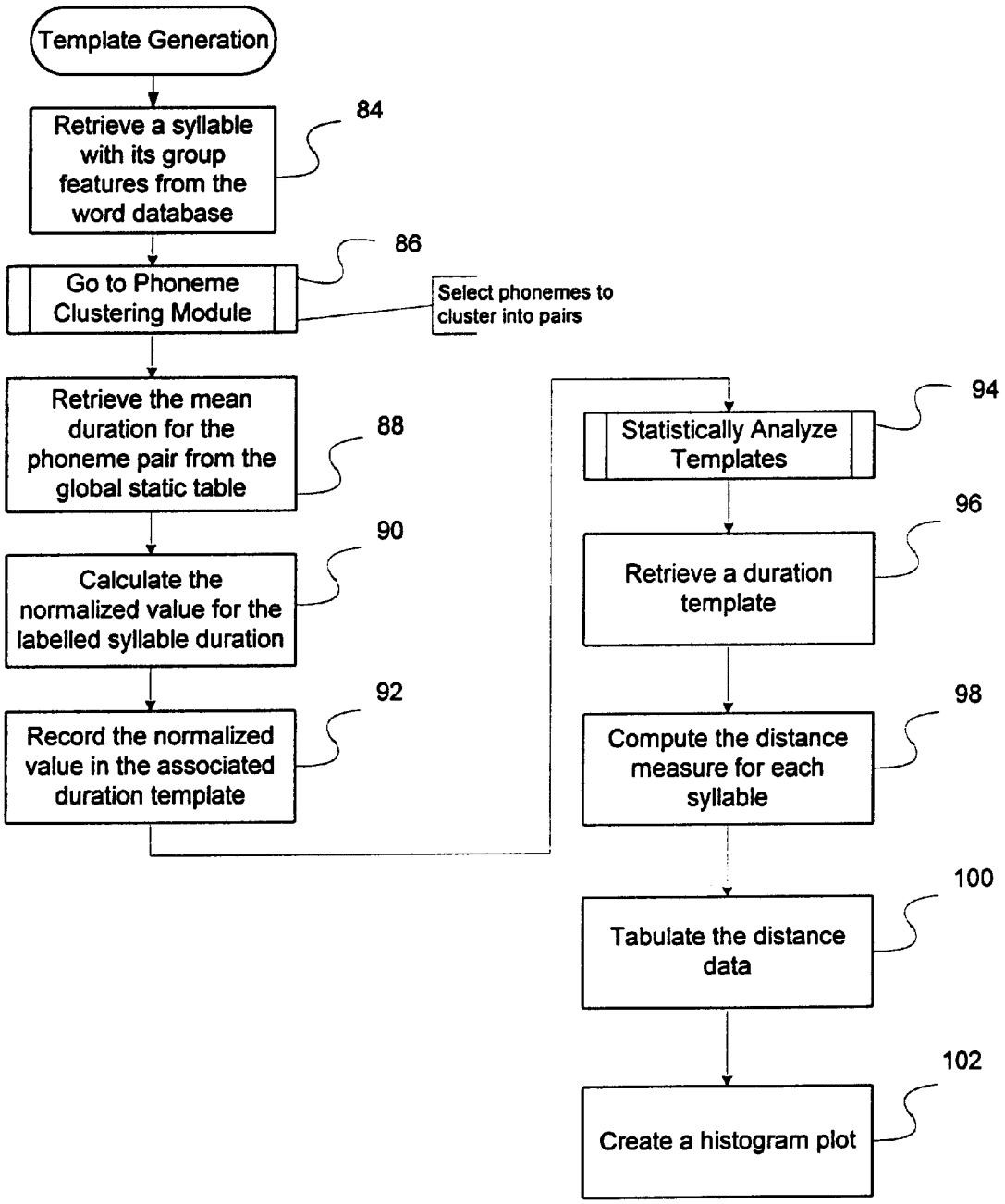
FIG. 6 is a flowchart diagram illustrating the duration template generation procedure employed by the presently preferred embodiment.

Referring to FIGS. 2 and 6, the procedure for constructing a duration template is illustrated. Obtaining detailed temporal prosody patterns is somewhat more involved than it is for F0 contours. This is largely due to the fact that one cannot separate a high level prosodic intent from purely articulatory constraints merely by examining individual segmental data. At step 84 a syllable with its associated group features is retrieved from the word database 30. At step 86 the phoneme clustering module 42 is accessed to segment the syllable into phoneme pairs and single phonemes. The details of the operation of the phoneme clustering module are the same as described previously. At step 88 the normalization module 44 retrieves the mean duration for these phonemes from the global static table 32 and sums them together to obtain the mean duration for each syllable. At step 90, the normalized value for a syllable is then calculated as the ratio of the actual duration for the syllable divided by the mean duration for that syllable.

$$t_i = \frac{s_i}{\sum_{j=1}^{m} x_j}$$

$t_i$=normalized value for syllable j $x_j$=mean duration of phoneme pair j m=number of phoneme-pairs in syllable i 1 $s_i$=actual measured duration of syllable i The normalized duration value for the syllable is recorded in the associated duration template at step 92. Each duration template comprises the normalized duration data for syllables having a specific grouping feature such as stress pattern.

To assess the robustness of the duration templates, some additional processing can be performed as illustrated in FIG. 6 beginning at step 94. As previously noted, prior neural network techniques do not give the system designer the opportunity to adjust parameters in a meaningful way, or to discover what factors contribute to the output. The present invention allows the designer to explore relevant parameters through statistical analysis. If desired, the data is statistically analyzed at step 96 by first retrieving a duration template for a specific stress pattern group.

A normalized syllable duration is analyzed by comparing each sample to the arithmetic mean in order to compute a measure of distance, such as the area difference as at step 98. A measure such as the area difference between two vectors as set forth in the equation below is used for the analysis. This measure is usually quite good at producing useful information about how similar or different the samples are from one another. Other distance measures may be used, including weighted measures that take into account psychoacoustic properties of the sensor-neural system.

$$d(T_k) = \sqrt{\sum_{i=1}^{N} (t_{ki} - \overline{T}_i)^2}$$

d=measure of the difference between two vectors i=syllable index of vector being compared $T_k$=normalized duration vector for sample k $\overline{T}$=arithmetic mean vector for group N=number of syllables t =duration value (syllable i in vector $T_k$)

For each pattern this distance measure is then tabulated as at step 100 and a histogram plot may be constructed as at step 102. By constructing histogram plots, the duration templates can be assessed to determine how closely the samples are to each other and thus how well the resulting template corresponds to a natural sounding duration pattern. In other words, the histogram tells whether the arithmetic mean vector is an adequate representative average duration template for this group. A wide spread shows that it does not, while a large concentration near the average indicates that a pattern determined by stress alone has been found, and hence a good candidate for the duration template.

Figure 8:
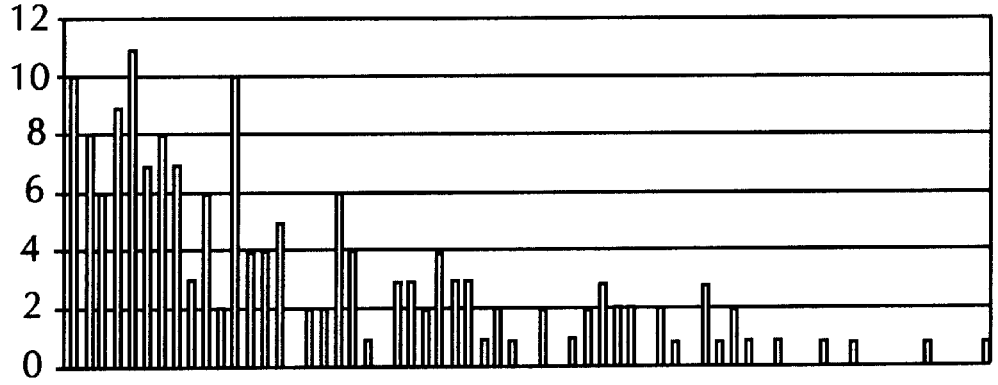
FIG. 8 is a distribution plot for a '10' stress pattern.

An example of such a histogram plot appears in FIG. 8, which shows the distribution plot for stress pattern '10.' In the plot the x-axis is on an arbitrary scale and the y-axis is the count frequency for a given distance. Dissimilarities become significant around ⅓ on the x-axis.

Figure 9:
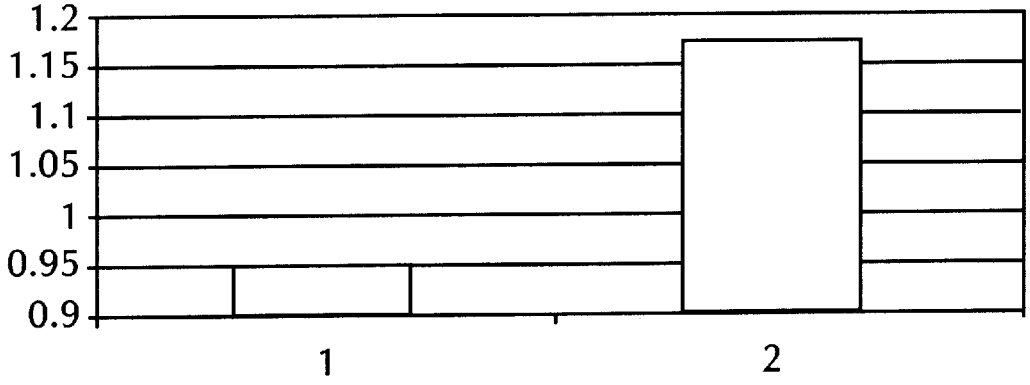
FIG. 9 is a graph illustrating template values for stress pattern '01'.

FIG. 9 shows a corresponding graph of the template values for the '01' pattern. Note that the graph in FIG. 9 represents normalized coordinates. The value 1 represents global average behavior, i.e. no prosodic effect. The syllables are numbered on the x-axis. FIG. 9 shows that the second syllable exhibits a significant lengthening factor which is due to the primary stress.

Figure 10:
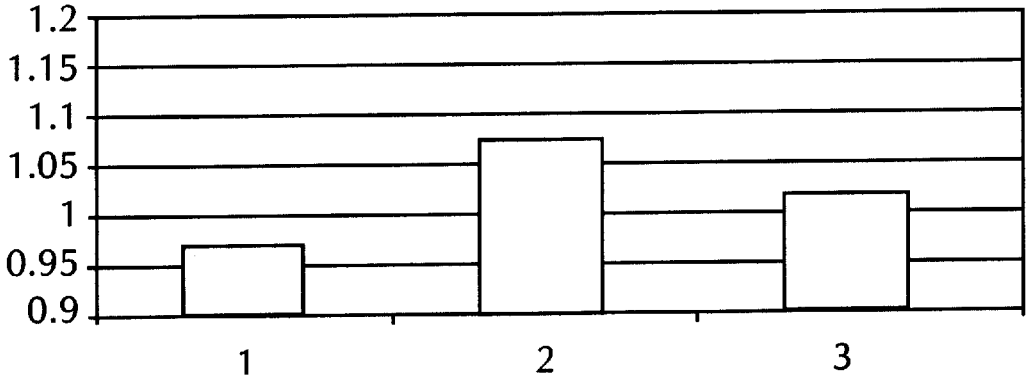
FIG. 10 is a graph illustrating template values for stress pattern '010'.
Figure 11:
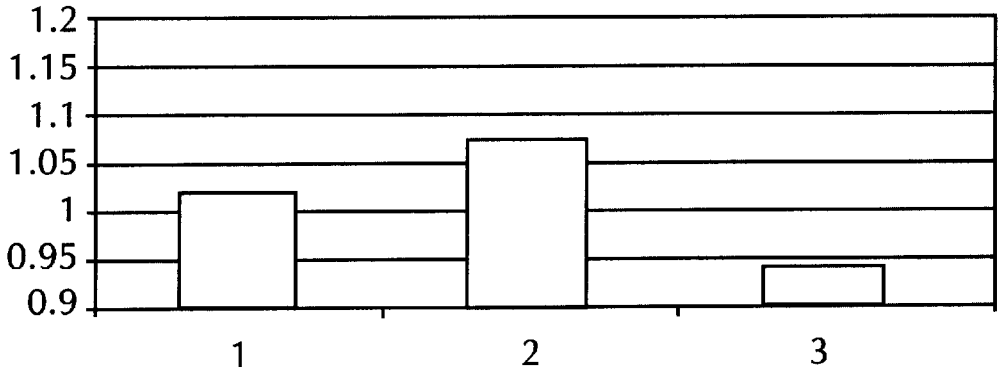
FIG. 11 is a graph illustrating template values for stress pattern '210'.

FIGS. 10 and 11 show the patterns of 3-syllable words '010' and '210' respectively. Note that the template values of the first syllables reflect different magnitudes of stress. Template value differences on the third syllables are opposite to the ones seen on the first syllables. This is probably triggered by some temporal compensation.

Figure 12:
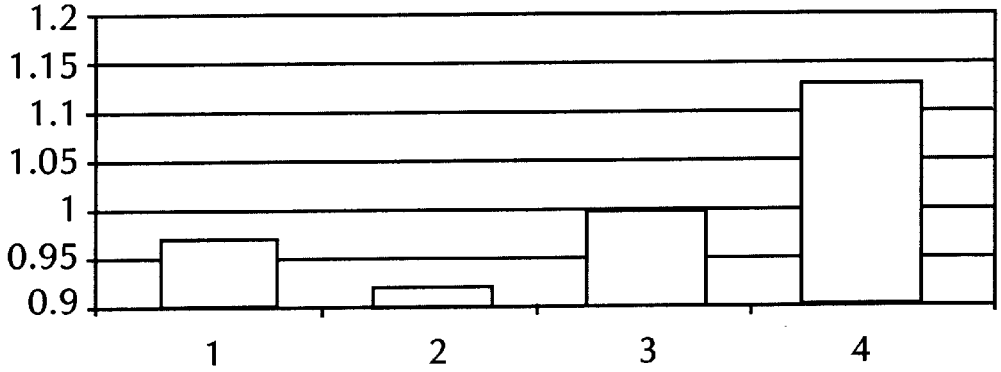
FIG. 12 is a graph illustrating template values for stress pattern '2021'.

Finally, FIG. 12 shows the 4-syllable pattern '2021.' Here again, the primary stress shows the highest value and the two secondary stress positions show the next highest values. These figures show unambiguously lengthening and shortening of syllables as a function of stress, without reference to its segmental constituents. This is most apparent with primary stress and less pronounced with the secondary stress which is also signaled by other acoustic cues.

The histogram plots and average duration pattern graphs may be computed for all different patterns reflected in the training data. Our studies have shown that the duration patterns produced in this fashion are close to or identical to those of a human speaker. Using only the stress pattern as the distinguishing feature we have found that nearly all plots of the duration pattern similarity distribution exhibit a distinct bell curve shape. This confirms that the stress pattern is a very effective criterion for assigning prosody information.

Figure 7:
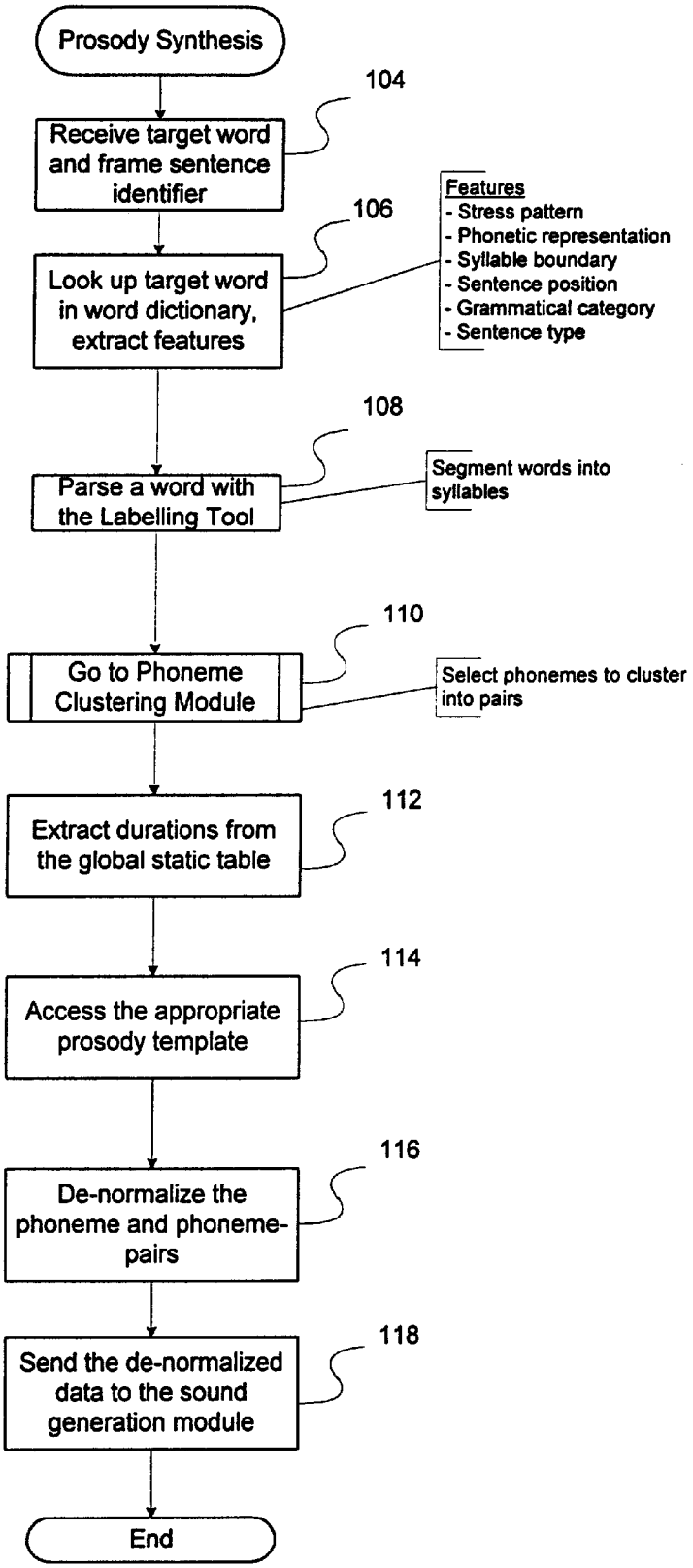
FIG. 7 is a flowchart diagram illustrating the prosody synthesis procedure employed by the preferred embodiment.

With the duration template construction in mind, the synthesis of temporal pattern prosody will now be explained in greater detail with reference to FIGS. 1 and 7. Duration information extracted from human speech is stored in duration templates in a normalized syllable-based format. Thus, in order to use the duration templates the sound generation module must first de-normalize the information as illustrated in FIG. 7. Beginning at step 104 a target word and frame sentence identifier is received. At step 106, the target word to be synthesized is looked up in the word dictionary 14, where the relevant word-based data is stored. The data includes features such as phonemic representation, stress assignments, and syllable boundaries. Then at step 108 text processor 12 parses the target word into syllables for eventual phoneme extraction. The phoneme clustering module is accessed at step 110 in order to group the phonemes into phoneme pairs and single phonemes. At step 112 the mean phoneme durations for the syllable are obtained from the global static table 32 and summed together. The globally determined values correspond to the mean duration values observed across the entire training corpus. At step 114 the duration template value for the corresponding stress-pattern is obtained and at step 116 that template value is multiplied by the mean values to produce the predicted syllable durations. At step 118, the transformed template data is sent to the sound generation module and ready to be used. Naturally, the de-normalization steps can be performed by any of the modules that handle prosody information. Thus the de-normalizing steps illustrated in FIG. 7 can be performed by either the sound generation module 24 or the prosody module 18.

From the foregoing it will be appreciated that the present invention provides an apparatus and method for constructing temporal templates to be used for synthesized speech, wherein the normally missing duration pattern information is supplied from templates based on data extracted from human speech. As has been demonstrated, this temporal information can be extracted from human speech and stored within a database of duration templates organized by grouping features such as stress pattern. The temporal data stored in the templates can be applied to the phonemic information through a lookup procedure based on stress patterns associated with the text of input words.

The invention is applicable to a wide variety of different text-to-speech and speech synthesis applications, including large domain applications such as textbooks reading applications, and more limited domain applications, such as car navigation or phrase book translation applications. In the limited domain case, a small set of fixed-frame sentences may be designated in advance, and a target word in that sentence can be substituted for an arbitrary word (such as a proper name or street name). In this case, pitch and timing for the frame sentences can be measured and stored from real speech, thus insuring a very natural prosody for most of the sentence. The target word is then the only thing requiring pitch and timing control using the prosody templates of the invention.

While the invention has been described in its presently preferred embodiment, it will be understood that the invention is capable of modification or adaptation without departing from the spirit of the invention as set forth in the appended claims.

What is claimed is:

1. A template generation system for generating a duration template from a plurality of input words, comprising:

a phonetic processor operable to segment each of said input words into input phonemes and group said input phonemes into constituent syllables, each of said constituent syllables having an associated syllable duration;

a phoneme clustering module to cluster said input phonemes comprising a constituent syllable into input phoneme pairs and input single phonemes;

a global static table containing a plurality of stored phonemes comprising stored phoneme pairs and stored single phonemes, each of said stored phonemes having associated static duration information;

a normalization module to generate a normalized duration value for each of said constituent syllables, wherein said normalized duration value is generated by dividing the syllable duration by the combined static duration of the corresponding stored phonemes that comprise said constituent syllable;

the duration template for storing the normalized duration value, said template being specified by text grouping feature, such that the normalized duration value for each constituent syllable having a specific grouping feature is contained in the associated duration template.

2. The template generation system of claim 1 further including a text grouping module operable to identify text grouping features associated with each of the constituent syllables.

3. The template generation system of claim 2 wherein said text grouping features are selected from the group of: word stress pattern, phonemic representation, syntactic boundary, sentence position, sentence type, phrase position, and grammatical category.

4. The template generation system of claim 1 further including a text grouping module operable to assign a stress level to each of the constituent syllables, wherein the stress level defines the text grouping feature for the constituent syllable.

5. The template generation system of claim 1 further comprising a word database for storing the input words with associated word and sentence grouping features.

6. The template generation system of claim 5 wherein the associated word grouping features are selected from the group of; phonemic representation, word syllable boundaries, syllable stress assignment, and the duration of each constituent syllable.

7. The template generation system of claim 5 wherein the associated sentence grouping features are selected from the group of; sentence position, sentence type, phrase position, syntactic boundary, and grammatical category.

8. The template generation system of claim 1 wherein the associated static duration information is selected from the group of: mean duration, standard deviation of the duration, maximum duration, minimum duration, and covariance.

9. The template generation system of claim 1 wherein the phoneme clustering module further includes a targeted combination criteria to determine which input phonemes to group into an input phoneme pair, wherein each of the input phoneme pairs complies with the targeted combination criteria.

10. The template generation system of claim 9 wherein the targeted combination criteria is selected from the group of:

a) "L" or "R" or "Y" or "W" followed by a vowel, b) a vowel followed by "L" or "R" or "N" or "M" or "NG", c) a vowel and "R" followed by "L", d) a vowel and "L" followed by "R", e) "L" followed by "M" or "N", and f) two successive vowels.

11. A method of generating a duration template from a plurality of input words, the method comprising the steps of:

segmenting each of said input words into input phonemes;

grouping the input phonemes into constituent syllables having an associated syllable duration;

clustering the input phonemes into input phoneme pairs and input single phonemes;

retrieving static duration information associated with stored phonemes in a global static table, wherein the stored phonemes correspond to the input phonemes that constitute the constituent syllable;

generating a normalized duration value by dividing the syllable duration by the combined static duration of the stored phonemes corresponding to the input phonemes that constitute the constituent syllable; and storing the normalized duration value in the duration template.

12. The method of claim 11 further comprising the steps of:

assigning a grouping feature to each of said constituent syllables; and specifying each of said duration templates by grouping feature, such that the normalized duration value for each constituent syllable having a specific grouping feature is contained in the associated duration template.

13. The method of claim 11 further comprising the steps of:

assigning grouping features to the constituent syllables; and storing the input words and constituent syllables with associated grouping features in a word database.

14. The method of claim 11 wherein the step of clustering the input phonemes into input phoneme pairs and input single phonemes further comprises the steps of;

searching the constituent syllable from left to right;

selecting the input phonemes in the constituent syllable that equate to a targeted combination; and clustering the selected input phonemes into an input phoneme pair.

15. The method of claim 14 further including the steps of:

searching the constituent syllable from right to left;

selecting the input phonemes in the constituent syllable that equate to the targeted combination; and clustering the selected input phonemes into an input phoneme pair.

16. A method of de-normalizing duration data contained in a duration template, the method comprising the steps of:

providing a target word to be synthesized by a text-to-speech system;

segmenting each of said input words into input phonemes;

grouping the input phonemes into constituent syllables having an associated syllable duration clustering the input phonemes into input phoneme pairs and input single phonemes;

retrieving static duration information associated with stored phonemes in a global static table, wherein the stored phonemes correspond to the input phonemes that constitute each of the constituent syllables;

retrieving a normalized duration value for each of the constituent syllables from an associated duration template; and generating a de-normalized syllable duration by multiplying the normalized duration value for each constituent syllable by the combined static duration of the stored phonemes corresponding to the input phonemes that constitute that constituent syllable.

17. The method of claim 16 further comprising the step of:

sending the de-normalized syllable duration to a prosody module so that synthesized speech having natural sounding prosody will be transmitted.

18. The method of claim 16 further comprising the step of:

retrieving grouping features associated with the target word from a word dictionary.

* * * * *